US011460237B2

(12) United States Patent
Pathapati et al.

(10) Patent No.: US 11,460,237 B2
(45) Date of Patent: Oct. 4, 2022

(54) DOOR ASSEMBLY FOR AN ENCLOSURE OF A REFRIGERATOR APPLIANCE

(71) Applicant: Haier US Appliance Solutions, Inc., Wilmington, DE (US)

(72) Inventors: Madan Gopal Reddy Pathapati, Louisville, KY (US); Herbert Sabelhaus, Evansville, IN (US); Mark Allen Stout, Elberfeld, IN (US); Michael William Basley, Evansville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/855,193

(22) Filed: Apr. 22, 2020

(65) Prior Publication Data

US 2021/0333041 A1 Oct. 28, 2021

(51) Int. Cl.
*F25D 23/02* (2006.01)
*E05D 3/18* (2006.01)
*E05D 11/08* (2006.01)

(52) U.S. Cl.
CPC ..... *F25D 23/028* (2013.01); *E05D 3/18* (2013.01); *E05D 11/087* (2013.01); *E05Y 2900/31* (2013.01); *F25D 2323/024* (2013.01)

(58) Field of Classification Search
CPC ... F25D 23/028; F25D 2323/024; E05D 3/18; E05D 11/087; E05Y 2900/31
USPC ..... 312/293.2, 325, 327, 405
See application file for complete search history.

(56) References Cited

U.S. PATENT DOCUMENTS 755,688 A * 3/1904 McDonald
3,292,983 A * 12/1966 Service ..... A47B 88/48 312/228
4,736,491 A * 4/1988 Mertes ..... E05D 3/18 16/358
4,843,680 A * 7/1989 Cress ..... E05F 1/1276 16/289
6,421,878 B1 * 7/2002 Kaneko ..... G06F 1/1681 16/330
7,735,943 B2 6/2010 Hottmann
9,157,677 B2 10/2015 Mitchell
(Continued)

FOREIGN PATENT DOCUMENTS

KR 100568520 B1 4/2006
KR 101979451 B1 5/2019

*Primary Examiner* — James O Hansen
(74) *Attorney, Agent, or Firm* — Dority & Manning, P.A.

(57) ABSTRACT

A refrigerator includes a cabinet defining a chilled chamber, an enclosure housing positioned within the chilled chamber, the enclosure housing defining an enclosure and a docking port configured for receiving a water filter, and a door assembly for providing selective access to the enclosure. The door assembly includes an access door pivotally mounted to the enclosure housing, a guide pin mounted to the enclosure housing, a guide bar having a first end and a second end opposite the first end, the first end being pivotally mounted to the access door and the second end defining a slot having the guide pin slidably received therein, a friction washer mounted on the guide pin adjacent the guide bar; and a spring member mounted on the guide pin and being configured for urging the friction washer against the guide bar to resist motion of the access door.

9 Claims, 9 Drawing Sheets

(56) References Cited

U.S. PATENT DOCUMENTS

| | | | | |
|---|---|---|---|---|
| 2004/0189164 | A1* | 9/2004 | Hwang | F25D 23/00 312/405 |
| 2008/0036348 | A1 | 2/2008 | Carden | |

* cited by examiner

DOOR ASSEMBLY FOR AN ENCLOSURE OF A REFRIGERATOR APPLIANCE

FIELD OF THE INVENTION

The present subject matter relates generally to refrigerator appliances, and more particularly to an enclosure door hinge and assembly for a refrigerator appliance.

BACKGROUND OF THE INVENTION

Refrigerator appliances generally include a cabinet that defines a chilled chamber for receipt of food articles for storage. In addition, refrigerator appliances may include an enclosure housing in which different controls or accessories are housed. The refrigerator appliances can also include various storage components mounted within the enclosure housing. Such storage components can include water filters, removal tools, shelves, or drawers that receive items and assist with organizing and arranging of such items within the enclosure housing. The enclosure housing can further include an access door rotatably hinged to the enclosure housing to permit selective access to the enclosure housing and conceal items within the enclosure when not in use or being accessed.

Notably, such access doors are commonly pivotally mounted to the enclosure using one or more hinge pins. Such hinge pins allow the access door to slam shut when released, resulting in loud noises, excessive component wear, and potential premature door failure. In addition, typical hinge mechanisms used on conventional door assemblies result in cumbersome access to the enclosure, e.g., by requiring two hands to operate and hold open the access door. In addition, certain door assemblies include more complicated hinge structures, but this increased hinge complexity may result in increased costs, premature failure of the hinge mechanism, or result in difficult access to enclosure housing.

Accordingly, an improved door assembly for providing access to an enclosure in a refrigerator appliance would be desirable. More specifically, an improved door assembly and hinge structure for providing easy, one handed access and a smooth closing operation to an enclosure access door would be particularly beneficial.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a chilled chamber, an enclosure housing positioned within the chilled chamber and defining an enclosure and a docking port, and a door assembly for providing selective access to the enclosure. The door assembly may include an access door pivotably mounted to a top of the enclosure housing, a guide pin mounted to the enclosure housing proximate a bottom of the enclosure housing, a guide bar having a first end and a second end, the first end being pivotably mounted to the access door and the second end defining a slot having the guide pin slidably coupled therein, a friction washer mounted on the guide pin adjacent the guide bar, and a spring member mounted on the guide pin and being configured for urging the friction washer against the guide bar to resist motion of the access door.

In another exemplary aspect of the present disclosure, a door assembly for providing selective access to an enclosure housing is provided. The door assembly may include an access door pivotally mounted to a top of the enclosure housing, a guide pin mounted to the enclosure housing proximate a bottom of the enclosure housing, a guide bar having a first end and a second end opposite the first end, the first end being pivotally mounted to the access door and the second end defining a slot having the guide pin slidably received therein, a friction washer mounted on the guide pin adjacent the guide bar, and a spring member mounted on the guide pin and being configured for urging the friction washer against the guide bar to resist motion of the access door.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
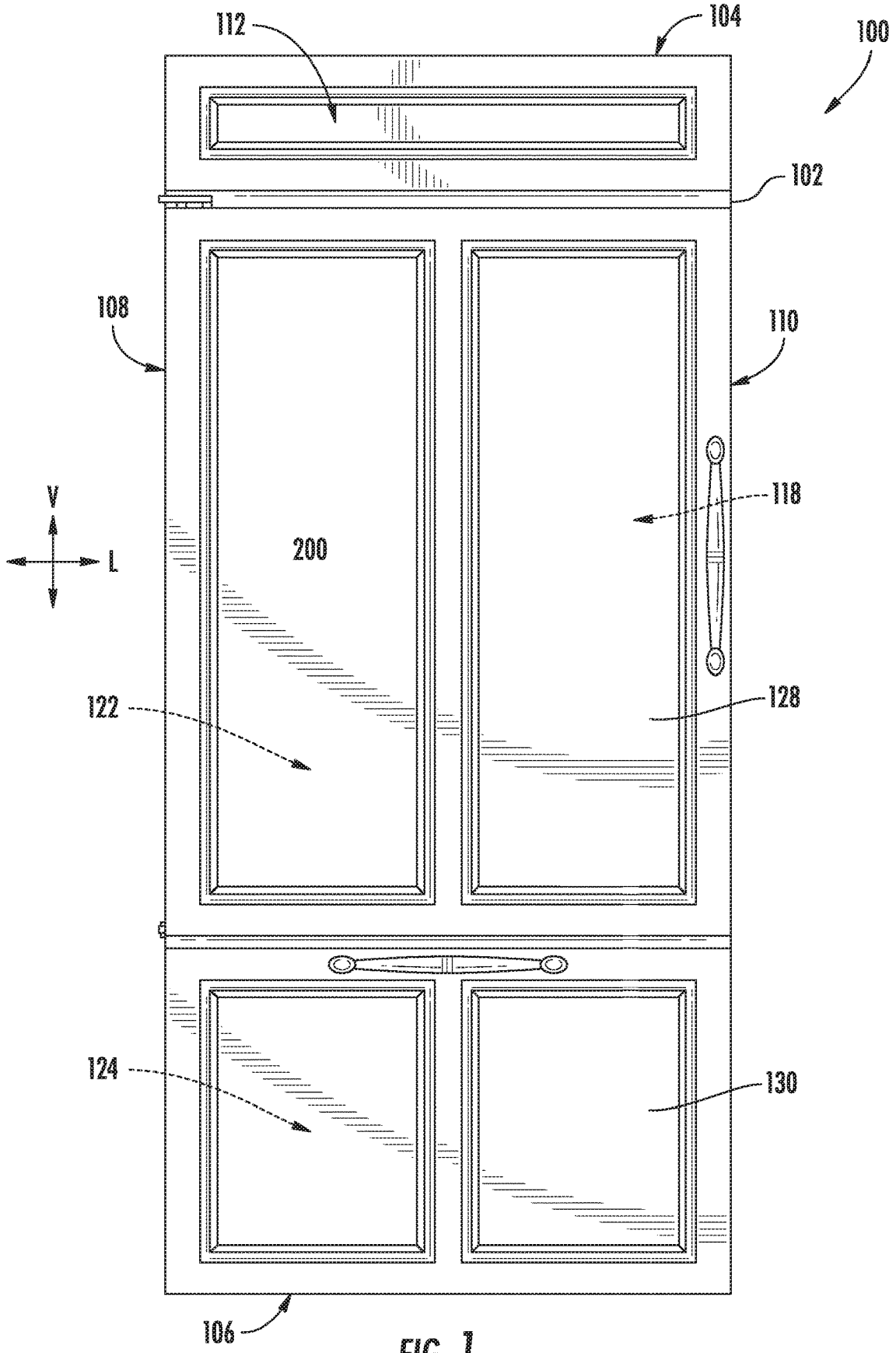
FIG. 1 provides a front view of a refrigerator appliance according to exemplary embodiments of the present disclosure, wherein the refrigerator door is closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Terms such as "inner" and "outer" refer to relative directions with respect to the interior and exterior of a refrigerator assembly. For example, "inner" or "inward" refers to the direction towards the interior of the refrigerator appliance. Terms such as "left," "right," "front," "forward," "back," "rearward," "top," or "bottom" are used with reference to the perspective of a user accessing the refrigerator appliance. For example, a user stands in front of the refrigerator to open the doors and reaches into the chilled chamber(s) to access items therein.

FIG. 1 provides a perspective view of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Figure 2:
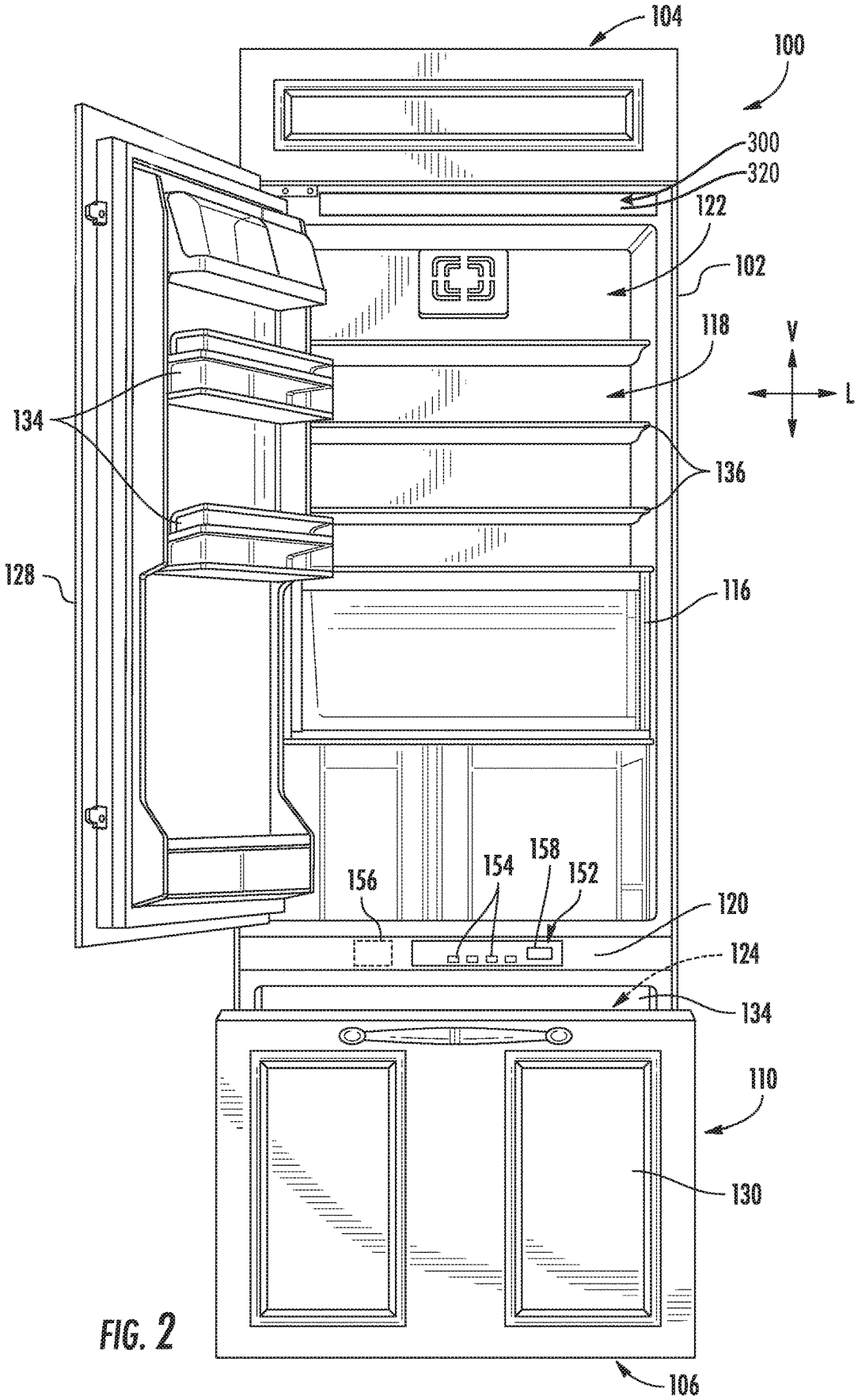
FIG. 2 provides a front view of the refrigerator appliance of FIG. 1, wherein the refrigerator door is open.

Refrigerator appliance 100 further includes a liner 116 that is typically positioned within and lines the interior of cabinet 102. More specifically, liner 116 is typically an insulated liner, e.g., such that it is spaced apart from cabinet 102 and the space therebetween is filled with an insulating foam or other suitable insulating material. As best shown in FIG. 2, liner 116 generally defines one or more chilled chambers, referred to herein generally by reference numeral 118, for receiving food items for storage. Specifically, according to the illustrated embodiment, liner 116 surrounds an interior surface of cabinet 102 and refrigerator appliance 100 further includes a mullion 120 that divides chilled chamber 118 into multiple chambers.

Specifically, according to the illustrated embodiment, mullion 120 is an extension of liner 116, extends along the horizontal direction H, and is similarly insulated. In this manner, mullion 120 divides chilled chamber 118 into a first chamber, e.g., a fresh food chamber 122, and a second chamber, e.g., a freezer chamber 124, within cabinet 102. In this regard, fresh food chamber 122 is positioned at or adjacent top 104 of cabinet 102 and freezer chamber 124 is arranged at or adjacent bottom 106 of cabinet 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance.

Refrigerator appliance 100 may further include one or more refrigerator doors 128 that are rotatably hinged to an edge of cabinet 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1 and in the open configuration in FIG. 2. One skilled in the art will appreciate that other chamber and door configurations are possible and within the scope of the present invention.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

A control panel 152 is provided for controlling the mode of operation. For example, control panel 152 includes one or more selector inputs 154, such as knobs, buttons, touch-screen interfaces, etc. In this regard, inputs 154 may be in communication with a processing device or controller 156. Signals generated in controller 156 operate refrigerator appliance 100 in response to selector inputs 154. Additionally, a display 158, such as an indicator light or a screen, may be provided on control panel 152. Display 158 may be in communication with controller 156, and may display information in response to signals from controller 156.

As used herein, "processing device" or "controller" may refer to one or more microprocessors or semiconductor devices and is not restricted necessarily to a single element. The processing device can be programmed to operate various components or subsystems of refrigerator appliance 100. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations.

A door assembly 300 may be provided for selectively opening and closing an enclosure 312 (to be described later). For example, the door assembly 300 may be located within fresh food chamber 122 for providing selective access to enclosure 312. In some embodiments, the door assembly 300 is located outside of the fresh food chamber 122. Specifically, the door assembly 300 is accessible without opening refrigerator door 128. The door assembly 300 may have any suitable location on the refrigerator appliance 100 such that a user can easily access the enclosure 312. As seen in FIG. 2, door assembly 300 may be located at or near a top of fresh food chamber 122. However, a location of door assembly 300 is not limited by this disclosure.

Figure 3:
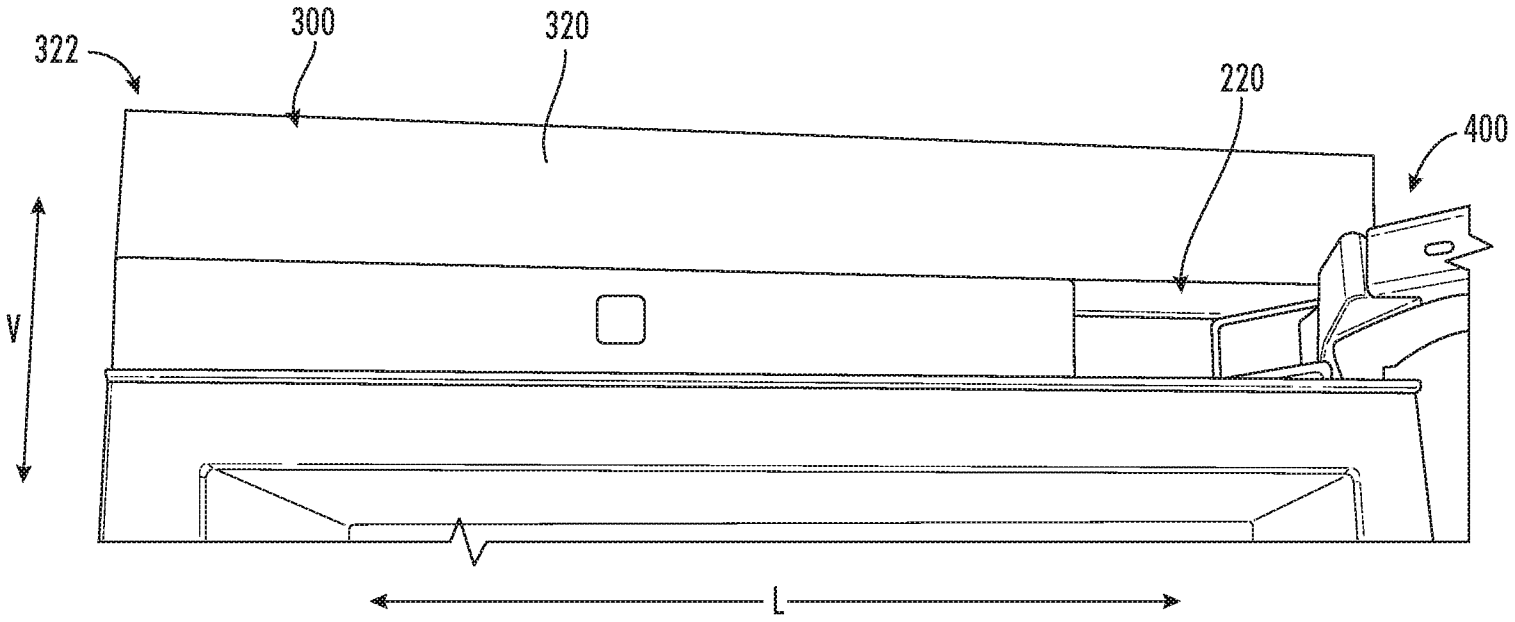
FIG. 3 provides a perspective view of a door assembly according to an exemplary embodiment of the present disclosure, wherein an access door is closed.

FIG. 3 provides a perspective view of a door assembly according to an exemplary embodiment of the present disclosure, wherein an access door is closed. As seen in FIG. 3, door assembly 300 may be provided at or near a top of refrigerator appliance 100. In one example, door assembly 300 is provided above a hinge 400 connecting refrigerator door 128 to cabinet 102. As such, a user may open door assembly 300 by inserting a finger or appendage into hinge cavity 220 and pulling on an access door 320 of door assembly 300. Additionally, or alternatively, it should be appreciated that any other suitable manner of manipulating access door may be used while remaining within the scope of the present subject matter, such as a handle. In addition, door assembly 300 may be located in any other suitable position within cabinet 102.

Figure 4:
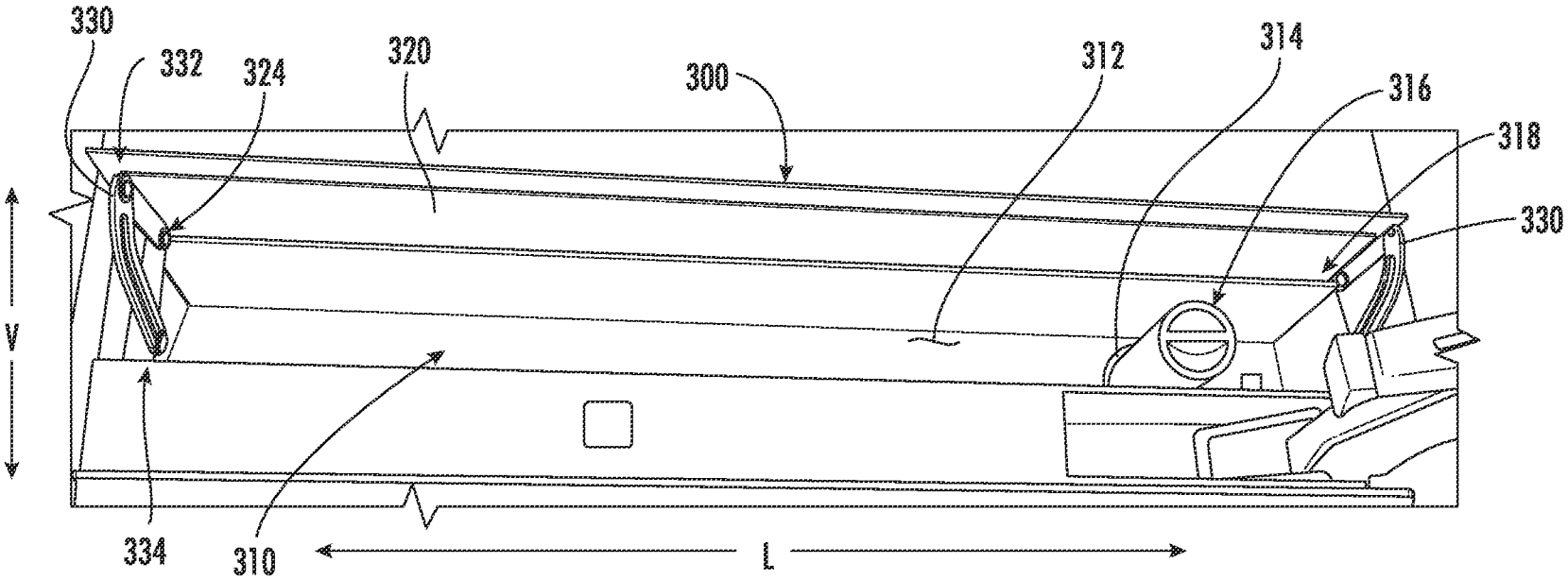
FIG. 4 provides a perspective view of the exemplary door assembly of FIG. 3, wherein the access door is open.

FIG. 4 provides a perspective view of a door assembly according to an exemplary embodiment of the present disclosure, wherein the access door 320 is open. As shown in FIG. 4, an enclosure housing 310 may be provided in cabinet 102. The enclosure housing 310 may be positioned within one or more of the chilled chambers 118. As shown, enclosure housing 310 is provided in fresh food chamber 122. The enclosure housing 310 may define an enclosure 312. For example, the enclosure 312 is a receiving chamber configured for receiving or storing various items. The enclosure 312 may include a docking port 314. The docking port may be configured to receive a water filter 316. The docking port 314 can be any port capable of accepting any suitable accessory (e.g., water filters, temperature sensors, humidity sensors, operative tools, or the like). The enclosure 312 may also be configured to receive and store other items, such as utensils, food items, medicines, or the like.

The door assembly 300 may be attached to the enclosure housing 310. The door assembly 300 may provide selective access to the enclosure 312. For instance, the door assembly 300 is configured to open and close a front face of the enclosure 312. The door assembly 300 may include the access door 320. The access door 320 may be pivotably mounted to a top 318 of the enclosure housing 310. In other words, when the access door 320 is in a closed position, a top 322 of the access door 320 in the vertical direction V may be pivotably or rotatably mounted to the top 318 of enclosure housing 310. The access door 320 may be attached to the enclosure housing 310 using any suitable means that allows the access door 320 to pivot about a first mounting point 324. For example, the access door 320 is attached to enclosure housing 310 via a first guide pin or clevis pin 350. A first retention feature 370 may be provided to retain the first guide pin 350 at the first mounting point 324. The first retention feature 370 may be located outside of the enclosure 312 (i.e., against an outer face 313 of the enclosure housing 310). The first retention feature 370 may be clip, a nut, a clamp, or any suitable retention feature. In one example, the first retention feature 370 is an E-clip.

The door assembly 300 may further include a guide bar 330 that guides the access door 320 as it pivots about the first mounting point 324. The guide bar 330 may have a first end 332 and a second end 334 opposite the first end 332. The first end 332 may be pivotably mounted to the access door 320. In other words, the first end 332 may define an aperture or first mounting hole 336 that passes through the guide bar 330 in the lateral direction L. The guide bar 330 may be formed of any suitable material. In one example, the guide bar 330 is formed of plastic. A second guide pin or clevis pin 352 may pass through the first mounting hole 336 to allow the guide bar 330 to pivot with respect to the access door 320. Although only one guide bar 330 is described here, two or more guide bars 330 may also be used to provide stability to the door assembly 300.

The access door may include a flange 340 that protrudes from a rear surface of the access door 320. When the access door 320 is in a closed position, the flange 340 may protrude in the transverse direction T and extend predominantly in the vertical direction V. As such, an aperture or first receiving hole 342 may be defined through the flange 340. Thus, the second guide pin or clevis pin 352 passes through the first mounting hole 336 of the guide bar 330 and the first receiving hole 342 of the flange 340. A second retention feature 372 may be provided to retain the second guide pin 352 at the first mounting hole 336. The second retention feature 372 may be located on an opposite side of the flange 340 from an insertion direction of the second guide pin 352. The second retention feature 372 may be clip, a nut, a clamp, or any suitable retention feature. In one example, the second retention feature 372 is an E-clip.

The second end 334 of the guide bar 330 may be slidably mounted to the enclosure housing 310. In this regard, for example, the guide bar 330 may define a slot 338 formed therein that extends from the second end 334 toward the first end 332 of the guide bar 330. The slot 338 may extend between about 70% to about 90% of the length of the guide bar 300 (e.g., as measure along a centerline of guide bar). In one example, the slot extends about 80% of the length of the guide bar 300. The slot 338 may pass through the guide bar 330 in the lateral direction L. In other words, the slot 338 may be formed such that a third guide pin or clevis pin 354 passes through the guide bar 330 in the lateral direction L. A second mounting point 326 may be defined at or near a bottom 319 of enclosure housing 310. The third guide pin 354 may pass through the slot 338 of the guide bar and may be fixed to the second mounting point 326. Notably, according to an exemplary embodiment, the curvature of guide bar 330 and slot 338 may be designed to follow the natural closing motion of the door. For example, guide bar 330 may be curved along one or both of the vertical direction V and the transverse direction T. Similarly, slot 338 may be curved along one or both of the vertical direction V and the transverse direction T and may follow the curve of guide bar 330.

The door assembly 300 may further include a third retention feature 374 for retaining the third guide pin 354 to the second mounting point 326. The third retention feature 374 may be located outside of the enclosure 312 (i.e., against an outer face 313 of the enclosure housing 310). The third retention feature 374 may be clip, a nut, a clamp, or any suitable retention feature. In one example, the third retention feature 374 is an E-clip.

Figure 5:
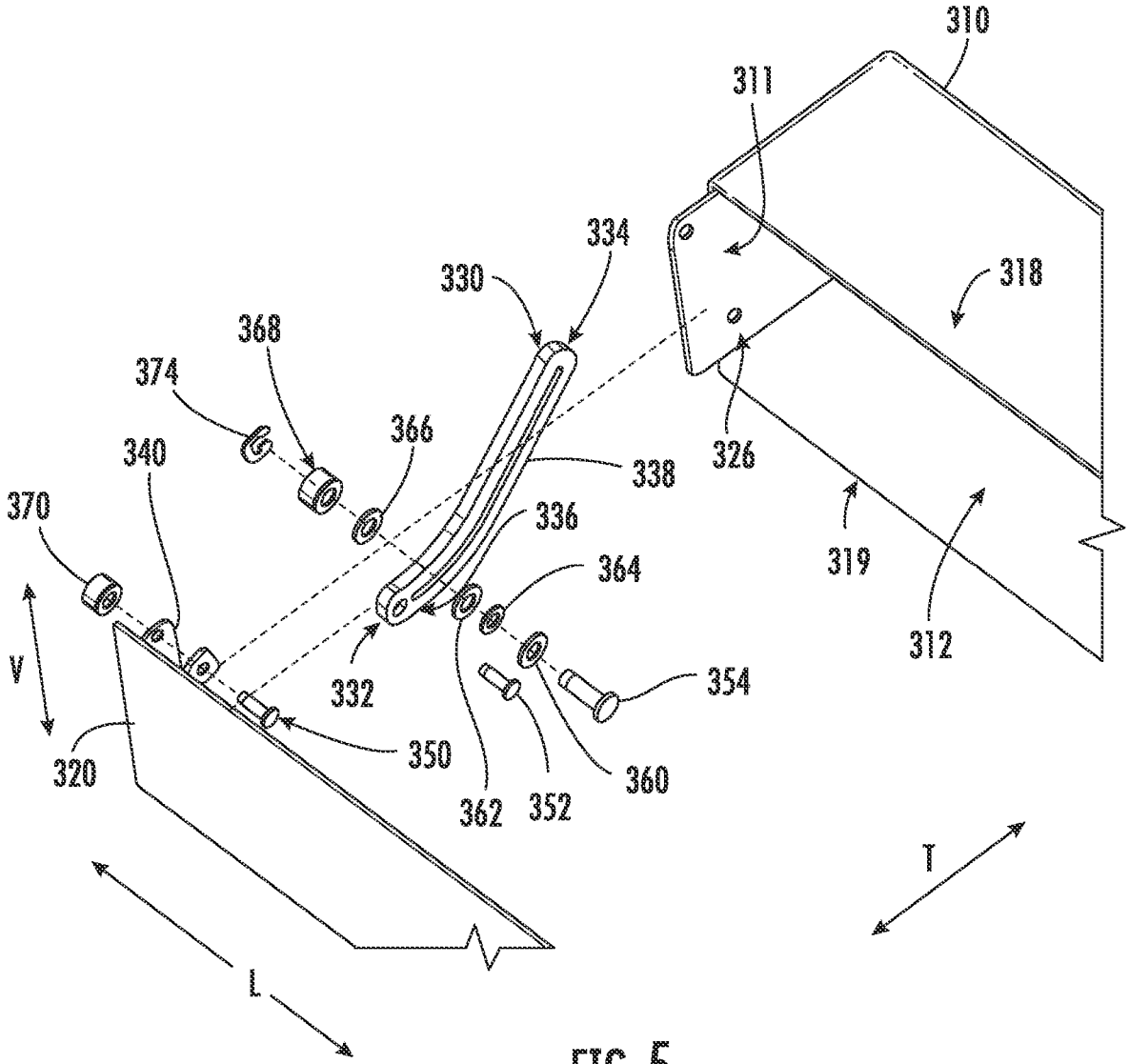
FIG. 5 provides an exploded perspective view of the exemplary door assembly of FIG. 3 according to an exemplary embodiment of the present disclosure.
Figure 6A:
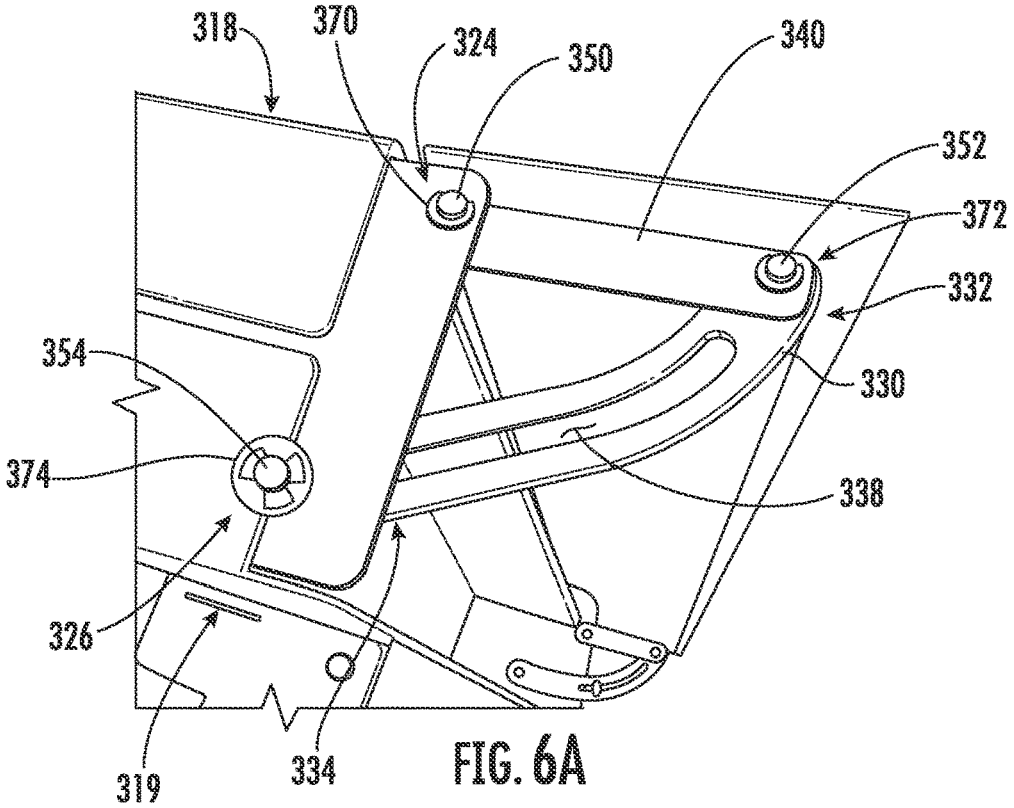
FIG. 6A provides a left-side perspective view of a guide bar of the exemplary door assembly of FIG. 3 according to an exemplary embodiment of the present disclosure.
Figure 6B:
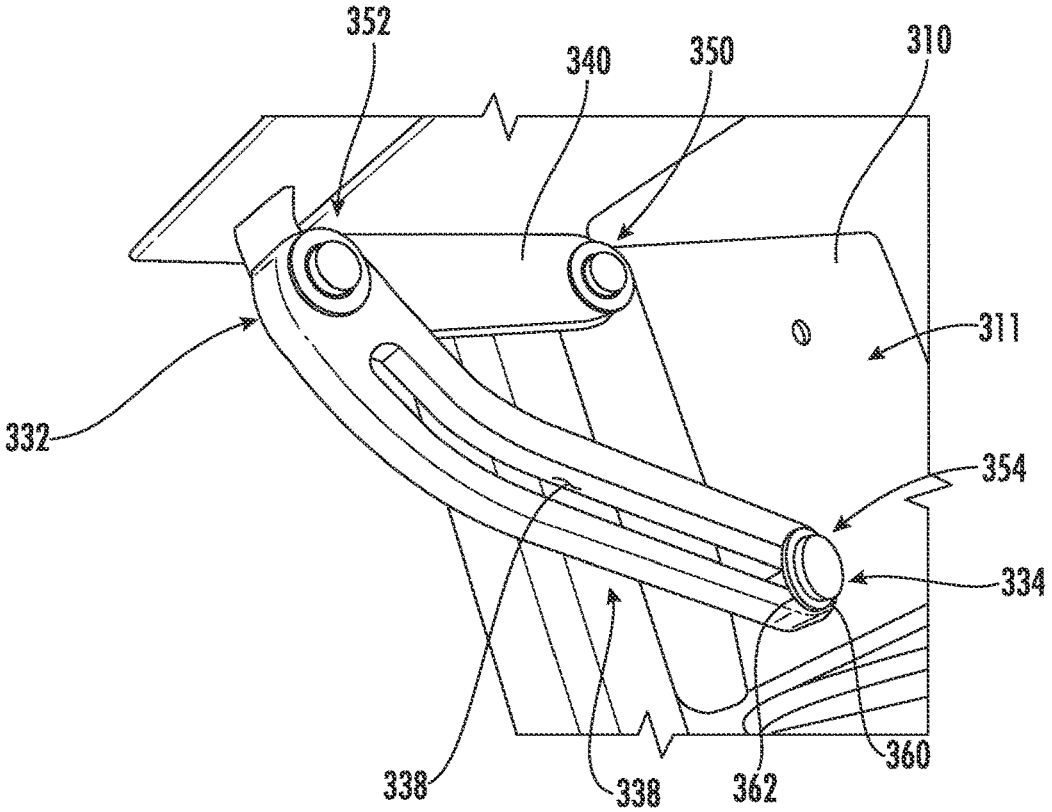
FIG. 6B provides a right-side perspective view of a guide bar of the exemplary door assembly of FIG. 3 according to an exemplary embodiment of the present disclosure.
Figure 7:
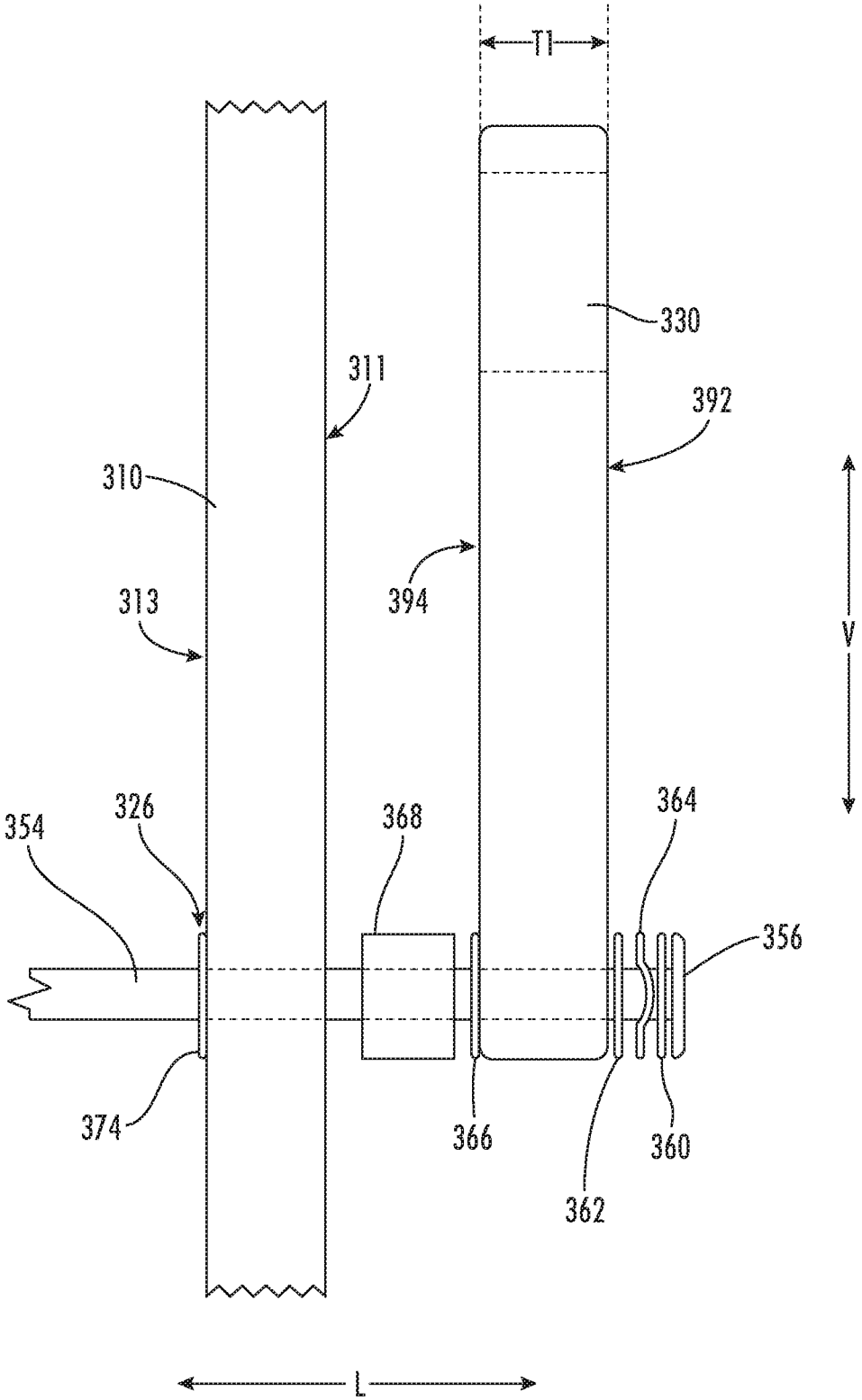
FIG. 7 provides a front perspective view of a guide pin of the exemplary door assembly of FIG. 3 according to an exemplary embodiment of the present disclosure.
Figure 8:
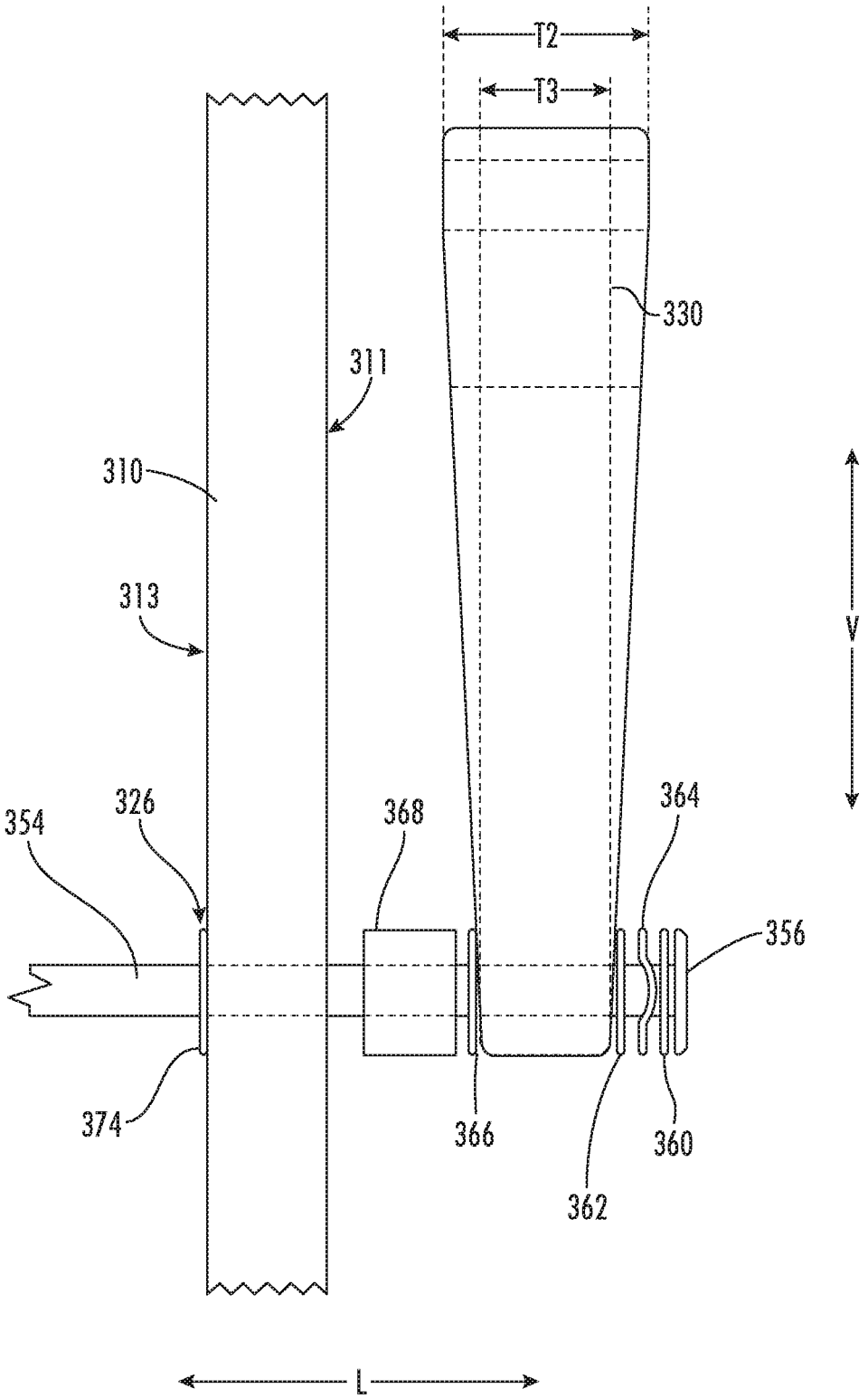
FIG. 8 provides a front perspective view of a guide pin of the exemplary door assembly of FIG. 3 according to another exemplary embodiment of the present disclosure.
Figure 9:
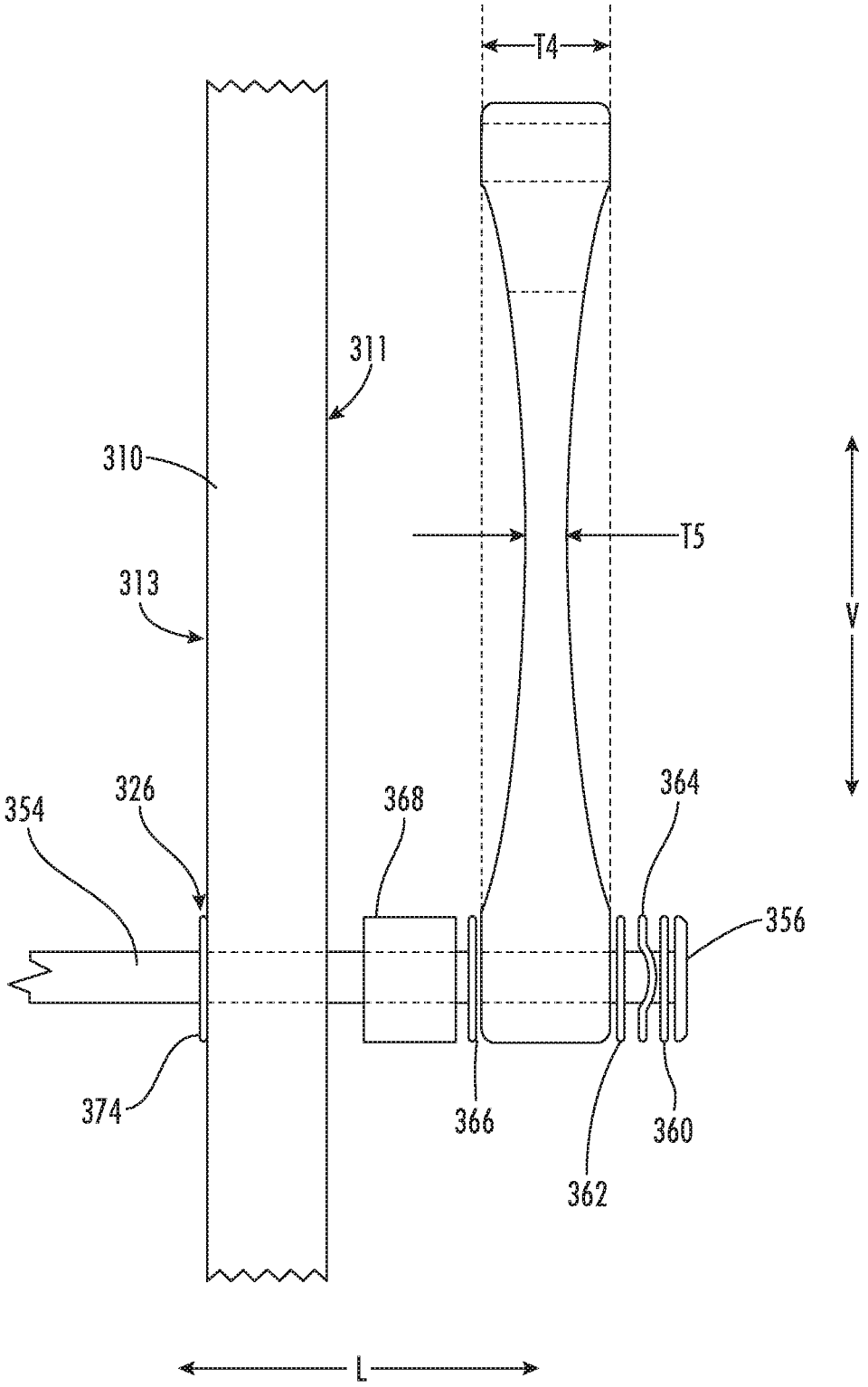
FIG. 9 provides a front perspective view of a guide pin of the exemplary door assembly of FIG. 3 according to another exemplary embodiment of the present disclosure.

FIG. 5 provides an exploded perspective view of a door assembly according to an exemplary embodiment of the present disclosure. FIG. 6A provides a left-side perspective view of a guide bar of a door assembly according to an exemplary embodiment of the present disclosure. FIG. 6B provides a right-side perspective view of a guide bar of a door assembly according to an exemplary embodiment of the present disclosure. FIG. 7 provides a front perspective view of a guide pin of a door assembly according to an exemplary embodiment of the present disclosure. FIG. 8 provides a front perspective view of a guide pin of a door assembly according to another exemplary embodiment of the present disclosure. FIG. 9 provides a front perspective view of a guide pin of a door assembly according to another exemplary embodiment of the present disclosure.

Referring to FIGS. 5 through 9, the door assembly 300 may include a first friction washer 360. The first friction washer 360 may be any suitable washer, for instance, a metal washer, a rubber washer, or a plastic washer. In one example, the first friction washer 360 is a metal washer. The first friction washer 360 may be mounted on the third guide pin 354. Specifically, the first friction washer 360 may be proximate a head 356 of third guide pin 354. A second friction washer 362 may be mounted on the third guide pin 354 adjacent to the first friction washer 360. The second friction washer 362 may contact an inner face 392 of the guide bar 330 (e.g., a lateral side of the guide bar 330 that faces an interior of the enclosure 312). The second friction washer 362 may be any suitable washer, for instance, a metal washer, a rubber washer, or a plastic washer. In one example, the second friction washer 362 is a metal washer.

The door assembly 300 may further include a spring member 364. The spring member 364 may be mounted on the third guide pin 354 and may be located between the first friction washer 360 and the second friction washer 362. The spring member 364 may urge or bias the second friction washer 362 against the guide bar 330 (e.g., toward the second mounting point 326 on an inner face 311 of the enclosure housing 310). In one example, the spring member 364 is a wave washer. Alternative spring members may be utilized, such as a coil spring, a Belleville washer, or a volute spring, for example. The spring member 364 may apply a constant force in the lateral direction. As such, the spring member 364 may apply a constant friction force between the guide bar 330 and the inner face 311 of the enclosure housing 310.

The door assembly 300 may further include a third friction washer 366. The third friction washer 366 may be any suitable washer, for instance, a metal washer, a rubber washer, or a plastic washer. In one example, the third friction washer 366 is a metal washer. The third friction washer 366 may be mounted on the third guide pin 354. The third friction washer 366 may be adjacent to an outer face 394 of the guide bar 330 (e.g., a lateral side of the guide bar 330 that faces the inner face 311 of the enclosure housing 310).

The door assembly 300 may further include a spacer 368 positioned on the third guide pin 354. The spacer 368 may be positioned between the inner face 311 of the enclosure housing 310 and the third friction washer 366. The spacer 368 may define a space between the guide bar 330 and the inner face 311 of the enclosure housing 310, subsequently reducing interference between the guide bar 330 and the enclosure housing 310. The spacer 368 may be formed of any suitable material capable of maintaining a predetermined distance between the guide bar 330 and the enclosure housing 310. In one example, the spacer 368 is plastic. In some embodiments, a fourth friction washer may be provided on the third guide pin 354 between the spacer 368 and the inner wall 311 of the enclosure housing 310. Furthermore, additional washers may be added, or referenced washers may be omitted according to specific embodiments and applications.

Referring now to FIGS. 7 through 9, a cross section of the guide bar 330 is illustrated according to various exemplary embodiments of the present subject matter. For example, with reference to FIG. 7, the guide bar 330 may have a constant cross section (e.g., a uniform thickness in the lateral direction L). In this regard, a lateral thickness T1 of the guide bar 330 may be constant from the first end 332 to the second end 334. As such, a constant friction force is applied between the guide bar 330 and the enclosure housing 310 throughout an entire opening or closing operation (e.g., as third guide pin 354 slides along a length of slot 338). Notably, the amount of friction and the resistance to closing force may be varied by adjusting features of the hinge assembly, such as the thickness of the guide bar 330, the spring constant of the spring washer 364, the length of the third guide pin 354, etc. For example, according to an exemplary embodiment, the spring member 364 may generate enough friction to hold the weight of the access door 320 at any position between the fully closed position (e.g., as shown in FIG. 3) and the fully open position (e.g., as shown in FIG. 4). Specifically, access door 320 may be moved to any desirable position and friction between the guide bar 330 and the inner face 311 of the enclosure housing 310 may maintain that position, e.g., to permit a user to change a water filter without needing to hold the access door 320 open.

Referring to FIG. 8, another embodiment of the guide bar 330 is shown. The guide bar 330 may have a variable cross section along its length (e.g., a non-uniform thickness in the lateral direction L). In detail, a lateral thickness T2 of the guide bar 330 at the first end 332 is greater than a lateral thickness T3 of the guide bar 330 at the second end 334. A variance of the lateral thickness of the guide bar 330 from the first end 332 to the second end 334 may be linear (i.e., the lateral sides of the guide bar 330 are straight). In alternate embodiments, a variance of the lateral thickness of the guide bar 330 from the first end 332 to the second end 334 may be non-linear (i.e., the lateral sides of the guide bar 330 are curved). Notably, adjusting the width or lateral thickness of the guide bar 330 along its length, the resistance of access door 320 movement may be adjusted along the travel length of the access door 320. For example, according to an exemplary embodiment, the guide bar 330 may be designed such that the access door 320 may perform a slow-close operation when moving from the open position to the closed position. In other words, during a closing of the access door 320, as the guide bar slides along the third guide pin 354, a friction force between the second friction washer 362 and the guide bar 330, and between the guide bar 330 and the inner face 311 of the enclosure housing 310 may increase. Thus, a rotational velocity of the access door 320 about the first guide pin 350 may be controlled (i.e., reduced from an open position to a closed position).

Referring to FIG. 9, another embodiment of the guide bar 330 is shown. The guide bar 330 may have a variable cross section (e.g., a non-uniform thickness in the lateral direction L). In detail, a lateral thickness T4 of the guide bar 330 at the first end 332 is the same as a lateral thickness T4 of the guide bar 330 at the second end 334. A lateral thickness of the guide bar 330 between the first end 332 and the second end 334 may be non-linear (i.e., the lateral sides of the guide bar 330 are curved). Specifically, a first linear side of the guide bar 330 proximate the inner wall 311 of the enclosure housing 310 may be concave toward a center of the enclosure 312. Further, a second linear side of the guide bar 330 distal the inner wall 311 of the enclosure housing 310 may be concave toward the inner wall 311 of the enclosure housing 310.

In detail, a width along the lateral direction of the guide bar 330 may be reduced from the lateral thickness T4 at the first end 332 of the guide bar 330, to a lateral thickness T5 at or near a center of the guide bar 330, and may be increased again from the lateral thickness T5 up to the lateral thickness T4 at the second end 334 of the guide bar 330. Accordingly, when the access door 320 is in a fully open position, the access door 320 may be held in the open position due to a friction force between the second friction washer 366 and the guide bar 330, and between the guide bar 330 and the inner wall 311 of the enclosure housing 310. Further, due to a curvature of the first and second lateral sides of the guide bar, during a closing of the access door 320, as the guide bar slides along the third guide pin 354, a friction force between the second friction washer 362 and the guide bar 330, and between the guide bar 330 and the inner face 311 of the enclosure housing 310 may increase. Thus, a rotational velocity of the access door 320 about the first guide pin 350 may be controlled (i.e., reduced from an open position to a closed position).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a chilled chamber and defining a vertical direction, a lateral direction, and a transverse direction;

an enclosure housing positioned within the chilled chamber, the enclosure housing defining an enclosure and a docking port configured for receiving a water filter; and a door assembly for providing selective access to the enclosure, the door assembly comprising:

an access door pivotally mounted to a top of the enclosure housing;

a guide pin mounted to the enclosure housing proximate a bottom of the enclosure housing;

a guide bar having a first end and a second end opposite the first end, the first end being pivotally mounted to the access door and the second end defining a slot having the guide pin slidably received therein;

a friction washer mounted on the guide pin adjacent the guide bar; and a spring member mounted on the guide pin and being configured for urging the friction washer against the guide bar to resist motion of the access door.

2. The refrigerator appliance of claim 1, wherein the spring member is provided between a head of the guide pin and the guide bar, and wherein the spring member applies a constant friction force between the guide bar and an inner face of the enclosure housing.

3. The refrigerator appliance of claim 2, wherein the friction washer comprises a pair of friction washers mounted on the guide pin on opposite sides of the guide bar, and wherein the spring member is positioned adjacent at least one of the friction washers opposite the guide bar.

4. The refrigerator appliance of claim 3, wherein the spring member is a wave washer.

5. The refrigerator appliance of claim 1, wherein the guide bar defines a width measured along the lateral direction, the width be constant along a length of the guide bar from the first end to the second end.

6. The refrigerator appliance of claim 1, wherein the guide bar defines a width measured along the lateral direction, the width being greatest proximate the first end where the guide bar is attached to the access door.

7. The refrigerator appliance of claim 1, wherein the guide bar defines a width measured along the lateral direction, and wherein the width at a center of the guide bar in the transverse direction is less than the width at both the first end and the second end.

8. The refrigerator appliance of claim 1, further comprising a plastic spacer positioned on the guide pin between the enclosure housing and the guide bar.

9. The refrigerator appliance of claim 1, wherein the guide bar is constructed from plastic.

* * * * *